US005154325A

United States Patent [19]

Ryder et al.

[11] Patent Number: 5,154,325

[45] Date of Patent: Oct. 13, 1992

[54] SOLUTION DELIVERY NOZZLE AND SYSTEM WITH ANTIMICROBIAL FEATURES

[75] Inventors: Francis E. Ryder, Arab; Rowland W. Kanner, Guntersville; Richard Rabenau, Arab, all of Ala.

[73] Assignee: Ryder International Corporation, Arab, Ala.

[21] Appl. No.: 639,589

[22] Filed: Jan. 9, 1991

[51] Int. Cl.[5] ..... B65D 37/00

[52] U.S. Cl. ..... 222/189; 222/212; 222/215; 222/494

[58] Field of Search ..... 222/420, 421, 212, 213, 222/215, 189, 490–496; 604/294–298

[56] References Cited

U.S. PATENT DOCUMENTS 4,533,068 8/1985 Meierhoefer ..... 222/189
5,033,647 7/1991 Smith et al. ..... 222/494 X

FOREIGN PATENT DOCUMENTS 3628197 2/1988 Fed. Rep. of Germany ..... 222/215

OTHER PUBLICATIONS

The Microban Effect, Microban Products Company, Sep. 1987.

*Primary Examiner*—Kevin P. Shaver

*Attorney, Agent, or Firm*—Trexler, Bushnell, Giangiorgi & Blackstone, Ltd.

[57] ABSTRACT

A liquid dispensing nozzle assembly for mounting on a squeezable liquid container and dispenser to maintain liquid in sterile condition during storage and repeated dispensing from the container, includes a conduit having a liquid discharge port leading to the ambience for discharge of the liquid therethrough to dispense liquid from the container. The liquid discharge port is formed in a discharge structure which eliminates microbial contamination of the discharge port during dispensing and storage of the liquid. Embodiments of the liquid dispensing nozzle have a liquid discharge structure including a composition comprising an antimicrobial component, in order to maintain microbially sterile condition of any liquid retained against the discharge structure following liquid dispensing therefrom. Additional embodiments of the nozzle structure of the invention include a tubular passage from which the liquid is discharged in which the tubular passage has a collapsible end portion defining a normally closed liquid discharge port. Tensioning members maintain tension on the end portion to retain the normally collapsed configuration thereof, while allowing the discharge port to be resiliently opened by exertion of hydraulic pressure, overcoming the imposed tension, from the liquid flow discharged therethrough.

16 Claims, 3 Drawing Sheets

Fig. 1
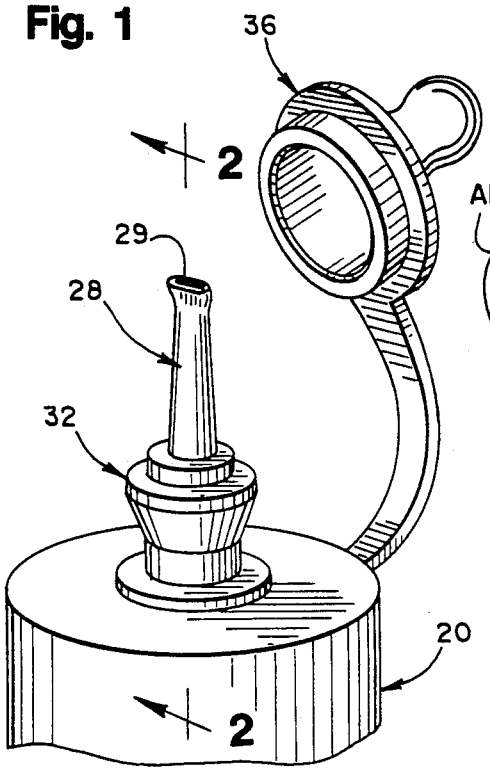
Fig. 3
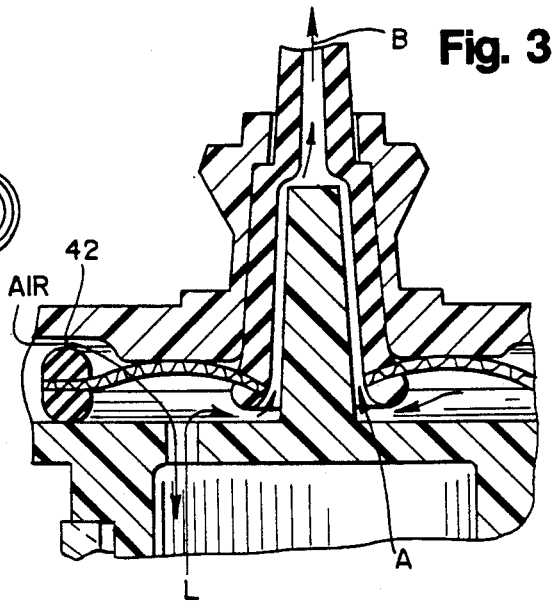
Fig. 4
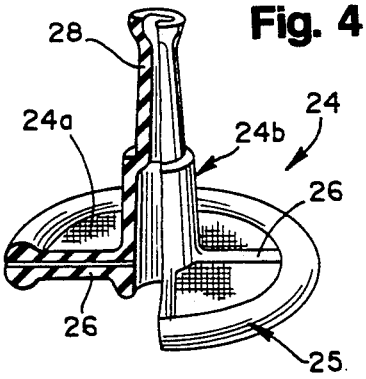
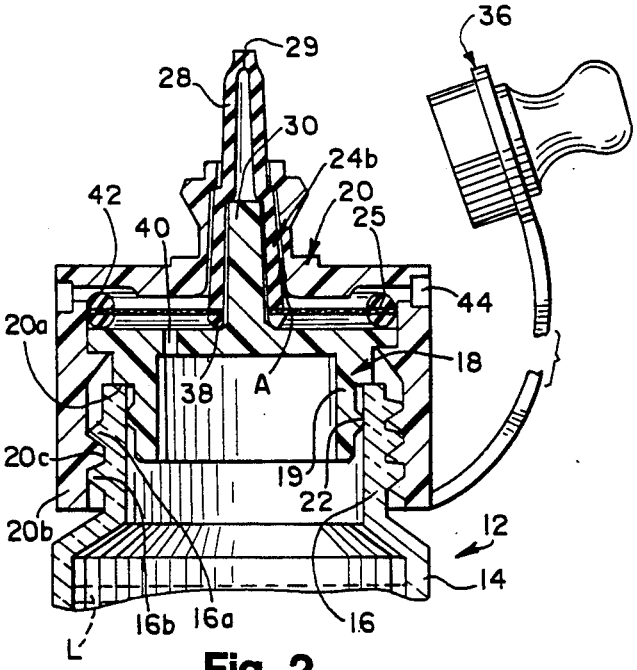
Fig. 2
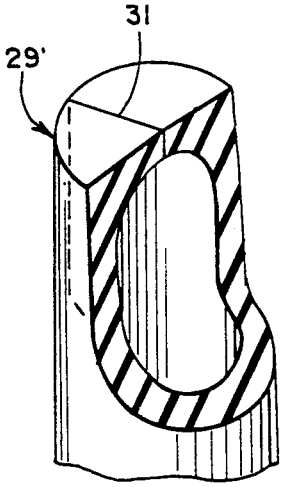
Fig. 5

Fig. 6
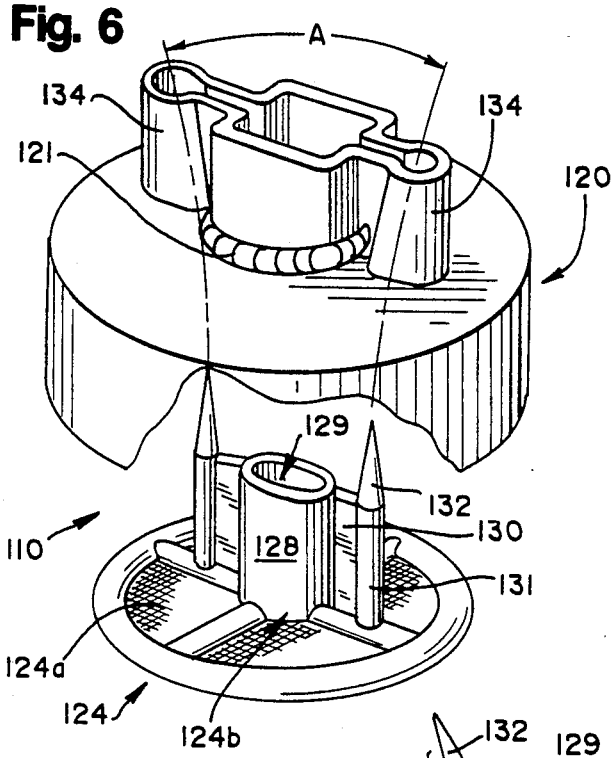
Fig. 8
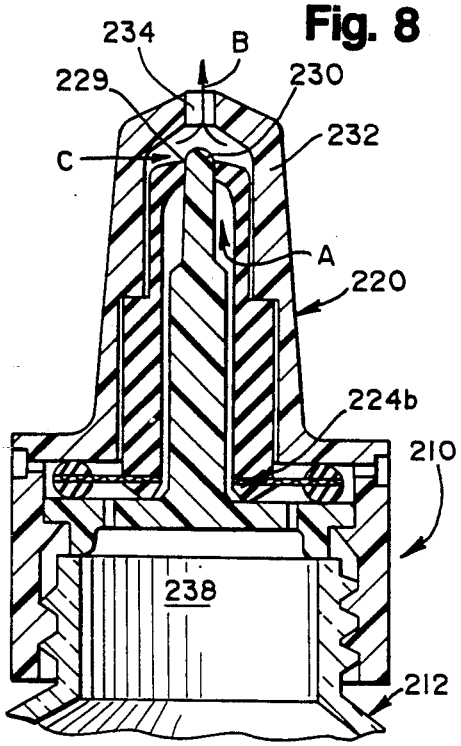
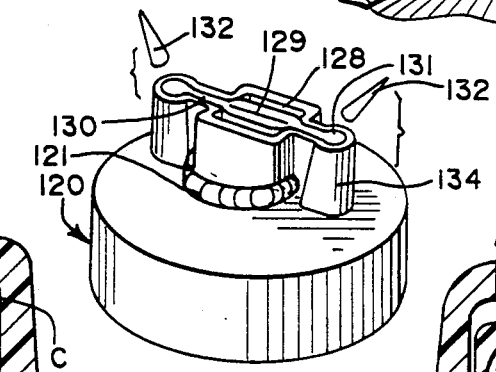
Fig. 7
Fig. 9
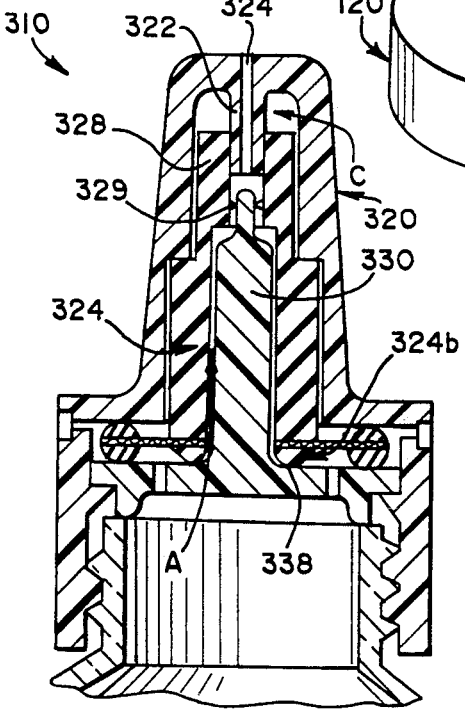
Fig. 10
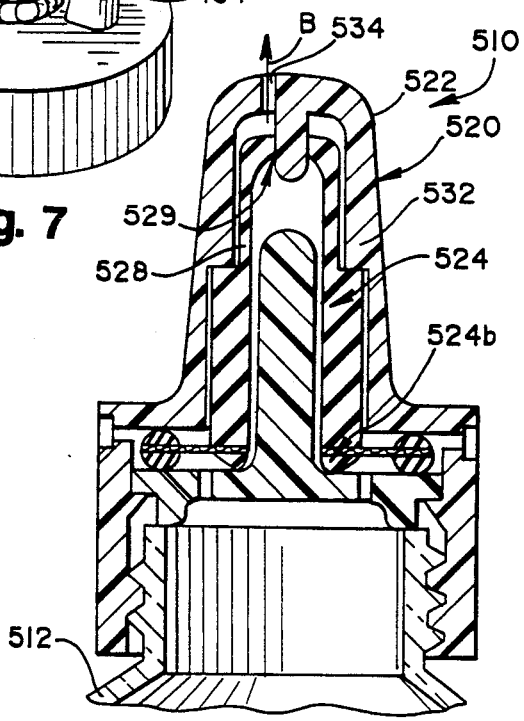

SOLUTION DELIVERY NOZZLE AND SYSTEM WITH ANTIMICROBIAL FEATURES

BACKGROUND OF THE INVENTION

The present invention relates to liquid storage containers for manually dispensing liquid such as cleaning solutions for contact lenses, and more particularly relates to dispensing nozzles for liquid which must be stored in sterile condition.

Liquids, for example, solutions for cleaning and conditioning contact lenses, have typically been stored in manually squeezable bottles from which the user can repeatedly dispense stored liquids. These liquids must be uncontaminated by microorganisms such as bacteria. Accordingly, expensive bactericidal agents have sometimes been included in the liquid formulation, as for example, in saline formulations for cleaning contact lenses. However, in addition to adding expense, bactericidal agents can cause minor eye irritation and are therefore preferably omitted from formulations for treating contact lenses.

To maintain the sterile condition of such stored liquids, squeezable dispensing bottles have been provided with nozzles including filter membranes which are impermeable to bacteria so that following each dispensing of solution the aspirated air does not carry bacteria into contact with the storage solution. Such nozzles including air filter membranes are described for example in U.S. Pat. No. 4,917,271 and in co-pending patent application Ser. No. 07/406,053, filed Sep. 11, 1989 and entitled LIQUID DISPENSER NOZZLE ASSEMBLY, the disclosure of which is incorporated herein by reference. However, the discharge port itself from which the dispensed liquid is discharged, can be exposed to the ambience and consequent microbial contamination. Such microbial contamination of the discharge port is eliminated in the liquid dispensing nozzles according to the present invention.

SUMMARY OF THE INVENTION

In accordance with the present invention a liquid dispensing nozzle assembly for mounting on a squeezable liquid container and dispenser to maintain liquid in sterile condition during storage and repeated dispensing from the container, includes a conduit having a liquid discharge port leading to the ambience for discharge of the liquid therethrough to dispense liquid from the container. The liquid discharge port is formed in a discharge structure which eliminates microbial contamination of the discharge port during dispensing and storage of the liquid.

Embodiments of the liquid dispensing nozzle have a liquid discharge structure including a composition comprising an antimicrobial component, in order to maintain microbially sterile condition of any liquid retained against the discharge structure following liquid dispensing therefrom. The discharge structure includes a housing portion within which a flow control portion of the conduit is arranged, and either or both of the housing and control portions can include the antimicrobial composition.

Other embodiments of the nozzle structure of the invention include a tubular passage from which the liquid is discharged in which the tubular passage has a collapsible end portion defining a normally closed liquid discharge port. Tensioning members maintain tension on the end portion to retain the normally collapsed configuration thereof, while allowing the discharge port to be resiliently opened by exertion of hydraulic pressure, overcoming the imposed tension, from said liquid flow discharged therethrough. The tensioning members and the tubular passage can be integrally molded as part of a diaphragm structure which controls one-way flow of the liquid through the conduit. The diaphragm structure can also include detachable extensions for assisting installation of the tensioning members within a housing in order to generate tensioned stretching of the tubular passage and the normally collapsed discharge end thereof. After assisting the tensioning installation of the tubular passage and diaphragm structure within the housing, the projections can be detached from the nozzle structure for subsequent use thereof in liquid storage and dispensing functions.

BRIEF DESCRIPTION OF THE DRAWINGS

FIG. 1 is a perspective view of an embodiment of the liquid nozzle assembly of the invention mounted on a liquid storage and dispensing container;

FIG. 2 is a sectional view along a plane indicated by lines 2—2 in FIG. 1;

FIG. 3 is an enlarged fragmentary view taken from FIG. 2 and illustrating the deflection of a valve element to open a liquid dispensing conduit in the nozzle assembly;

FIG. 4 is a partially sectional, perspective view of the integral diaphragm and liquid discharge element illustrated in FIGS. 1-3;

FIG. 5 is fragmentary, partially sectional, perspective view of a modified liquid discharge portion on an integral element similar to FIG. 4;

FIG. 6 is a perspective view of the installation of a modified integral diaphragm and liquid discharge structure employed in a second embodiment of a nozzle assembly in accordance with the invention;

FIG. 7. is a perspective view of the completed installation of the element within a housing of the nozzle assembly shown in FIG. 6;

FIG. 8 is a sectional view similar to FIG. 2, illustrating a third embodiment of a nozzle assembly in accordance with the invention;

FIG. 9 is a sectional view of a fourth embodiment of a nozzle structure in accordance with the invention;

FIG. 10 is a sectional view of a fifth embodiment of a nozzle structure in accordance with the invention;

DESCRIPTION OF THE ILLUSTRATED EMBODIMENTS

Figure 11:
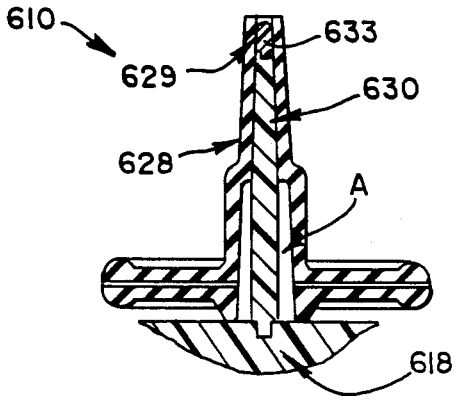
FIG. 11 is a fragmentary sectional view of a sixth embodiment of a nozzle assembly in accordance with the invention.

Referring to FIGS. 1-3, an embodiment of a nozzle assembly in accordance with the invention and designated generally by reference character 10 is shown mounted on a molded plastic bottle or liquid container 12 having a flexible or squeezable wall 14 and containing sterile liquid L such as saline solution.

The container 12 opens at the top from a neck portion 16. An adapter portion 18 of the nozzle assembly generally closes the mouth of the neck 16 and has a cylindrical wall 19 which projects downwardly into the opening of the neck 16 with a radially flared, annular lug projection which securely seals against the interior surface of the neck. The upper surface of the adapter 18 supports a partitioned, elastomeric diaphragm 24 which integrally includes both air filtering portion **24*a* and a valve element portion 24*b* as more fully described hereinafter. The elastomeric diaphragm 24 also includes a thickened, annular peripheral bead 25 which is clamped between the upper surface of the adapter 18 and the lower surface of an overlying housing or cap member 20. The circumferential periphery of the upper all of the adapter 18 is seated on an inner annular shelf 20*a* which projects radially inwardly from a downwardly extending cylindrical skirt portion 20*b* of the cap 20. The skirt 20*b* also has a radially inwardly projecting annular lug 20*c* which is forced between a pair of adjacent annular coupling flanges 16*a* and 16*b* which enable an interference fit of the lug 20*c* therebetween to secure the clamping of the diaphragm 24 and adapter 18 on the bottleneck 16**.

Referring particularly to FIGS. 3 and 4, in the illustrated embodiment, the air filter portion **24*a* of the integrated, elastomeric diaphragm 24 can be insert molded in which an annulus of the filter material is inserted during molding of the diaphragm 24 from elastomeric material, for example, silicone rubber. The filter material is embedded and supported at its inner periphery by the diaphragm valve portion 24*b* and at the outer periphery by the bead 25 so that the annular medial portion is exposed to form the air filter portion 24*a*; for added structural integrity, the filter material may be embedded within radial ribs 26 of the elastomeric material. The filter membrane material of the portion 24*a* is hydrophobic to prevent passage of the sterile liquid L (saline solution) and is also impermeable to bacteria but is permeable to air so that the aspirating air is filtered to prevent entrained bacteria from contaminating the sterile liquid during aspiration as more fully described hereinafter. Suitable air permeable hydrophobic filter material for the diaphragm air filter portion 24*a*** can be fabricated, for example, from supported acrylic copolymer treated with a siloxane composition such as the filter membrane material commercially available from Gelman Sciences in a particularly suitable composition designated Versapor-450 having a pore size of approximately 0.45 micron which is impenetrable by bacteria.

The diaphragm 24 also includes a tubular nozzle portion 28 which integrally extends upwardly from a larger elastomeric, tubular column or valve portion **24*b*. The interior surface of the columnar valve portion 24*b* fits loosely around a nipple formation 30 which projects upwardly from the upper wall of the adapter 18 to provide a conical clearance space A therebetween as best shown in FIGS. 2 and 3. The clearance space A leads to the central bore of the tubular portion 28 which has a collapsed liquid discharge orifice or "duckbill" valve opening 29** at its upper end, which opens with hydraulic pressure of the dispensed liquid L indicated by arrow B as more fully described hereinafter.

The tubular nozzle portion 28 is supported by an annular boss 32 whose surface seals against the annular upper surface 34 of the tubular valve portion **24*b*. A snap-fitting cover 36 connected to cap 20 is provided to removably fit over the tubular nozzle 28 and boss 32**.

The tubular column or valve portion **24*b* extends downwardly and terminates in a tapered sealing ring 38 which normally seals, under compression by the boss 32 against the upper wall surface of the adapter 18 adjacently surrounding the nipple 30 to prevent leakage of the stored liquid L even under hydrostatic pressure when the container 12 is inverted during handling, and to prevent any backflow of non-sterile air or liquid from the clearance space A into the bottle neck 16. In order to maintain microbially sterile condition of any liquid L retained following liquid dispensing, the entire tubular nozzle 28 and valve column 24*b* or just the terminal duckbill valve opening 29 can be molded or treated with an antimicrobial component, for example elastomer and resin additives commercially available under the trademark MICROBAN® from Microban Products Company of Winston-Salem, NC. The backflow of liquid is additionally prevented by the projection of the conically shaped nipple 30 into the tubular nozzle portion 28 in order to minimize the volume of liquid remaining in the tubular portion 28 and valve portion 24*b* when the dispensing flow is stopped. Since the discharge orifice or duckbill valve opening 29 will immediately close with the drop in hydraulic pressure when the dispensing liquid flow is stopped, virtually no air can enter the closing orifice 29, and the antimicrobial composition of the terminal duckbill valve 29 eliminates microbial contamination of any traces of residual fluid which might remain therein as it closes, as well as, maintaining microbially sterile condition of the collapsed opening 29** itself. Furthermore, proper initial flushing further ensures sterile condition of successive liquid dispensing.

Referring to FIG. 3, when the flexible container wall 14 is squeezed to dispense the liquid L from the inverted container 12 and nozzle assembly 10, the liquid flows through the passageway bore and exerts the necessary threshold hydraulic pressure against the liquid-impermeable filter portion **24*a* of the diaphragm 24 which is resiliently deflected to further compress the valve portion 24*b* against the boss 32; the additional compression of the valve portion 24*b* thereby displaces and unseats the annular sealing ring 38 to enable the liquid flow into the adjacent portion of the annular clearance space A (which is enlarged by the diaphragm deflection). The cap 20 has a narrow vent groove 42 as shown in FIG. 2 which is located on the dry or non-liquid side above the diaphragm 24 to enable air displacement with the deflection of the diaphragm 24**.

The liquid flow through the clearance space A leads to discharge of the liquid through the tubular nozzle 28 and duckbill valve 29 as indicated by the arrow B. The elastomeric valve portion **24*b* and sealing ring 38 perform as a one-way valve allowing only outflow of dispensed liquid when the flexible container wall 14 is squeezed. Once the additional compression of the valve portion 24*b*** is relaxed when the manual squeeze is released, the residual compression of the valve portion 24*b* will cause the sealing ring 38 to reseat and firmly seal against the wall of the adapter 18 to close the one-way valve and prevent any backflow of liquid or air from the clearance space A. The valve portion column 24*b* thus acts as an integral and elastomeric biasing spring on the sealing ring 38. The duckbill valve 29 prevents backflow of air into the tubular portion 28 and clearance space A.

Referring again to FIGS. 2 and 3, in order to aspirate air for reinflation of the squeezed container wall 14 and to replace the liquid dispensed, ambient air is drawn into an entrance passageway 44 and is downwardly directed and filtered through the filter portion 24*a* above the passageway bore 40 through which the air flows through the adapter 18 and container neck 16 as indicated by the air flow path C in dashed line. The filter portion 24*a* of the diaphragm 24 thus serves dual function as both the aspiration air filter as well as the hydraulically deflectable portion of the diaphragm valving in the liquid dispensing conduit. Accordingly, the integration of the hydraulically deflectable air filter within the diaphragm structure enables particularly uncomplicated flow path of the air aspiration conduit and a simplified nozzle assembly without jeopardizing contamination of the sterile liquid during storage and successive dispensing. When air aspiration through the diaphragm is not necessary for replacement of the dispensed liquid, the air filter portion of the diaphragm can be omitted and merely replaced by deflectable continuation of diaphragm material.

Referring to FIG. 5, a modified, terminal valve portion 29' can be molded to form a generally circular prism portion having a normally closed slit 31 which resiliently opens with the hydraulic pressure of the dispensed fluid, and then closes to prevent entry of potentially contaminating air. The modified valve portion 29' is molded or treated with an antimicrobial component to maintain microbially sterile condition of liquid in contact therewith.

Referring to FIGS. 6 and 7, a second embodiment of the nozzle assembly in accordance with the invention is designated generally by reference character 110. The nozzle assembly is similar to the nozzle assembly shown in FIGS. 1–4 but in which the discharge port 129 at the discharge end of the tubular nozzle portion 128 requires imposed tensioning in order to maintain collapsed closure thereof in the normally closed condition shown in FIG. 7 when the integral diaphragm structure 124 including filter portion 124*a* and valve portion 124*b* are installed within the housing or cap portion 120 and valve bass 121. FIG. 6 illustrates the condition of the integral diaphragm structure 124 prior to its installation within the housing cap 120 as shown in FIG. 7. In the pre-installed condition of FIG. 6, the discharge portion 129 is open in the absence of imposed tension forcing collapse and closure of the port 129 as shown in FIG. 7. In order to impose stretching tension to collapse the open port 129 shown in FIG. 6, the tubular nozzle portion 128 is provided with an integrally formed pair of diametrically opposing flange portions 130. Each of the flange portions 130 has an enlarged anchor portion 131 formed at the radially outward end thereof. Projecting from each of the anchor portions 131 is a tapered projection 132 which extends axially beyond the discharge port 129.

During the installation of the integral diaphragm structure 124 within the housing cap 120, as shown in FIG. 6, the projections 132 are guided into and through the interior of a respective tubular passage 134 so that they project from the opposite ends of the passages 134 as indicated by dashed lines A. The passages 134 are sufficiently spaced so that the continued insertion of the anchor portions 131 through the passages 134 requires a pulling force on the projections 132 which imposes tensioning stretch of the elastomeric tubular nozzle portion 128 between the passages 134. The stretch results in collapse of the discharge port 129 so that the port closes and seals upon itself in the fully installed position shown in FIG. 7. Thereafter, the projections 132 can be severed and discarded, having served merely to guide and transmit the stretching and installation of the tubular nozzle portion 128 within the housing cap 120.

The normally collapsed port 129 will resiliently open with the hydraulic pressure of the dispensed fluid overcoming the tensioned closure, and when the fluid flow is stopped, the tensioning force automatically recollapses the port 129 to prevent entry of potentially contaminating air. Optionally, the tubular nozzle portion 128 and the collapsible port 129 can be molded from antimicrobial composition.

Referring to FIG. 8, a third embodiment of the nozzle assembly in accordance with the invention and designated generally by reference character 210 is similar to the nozzle assembly 10 but in which the entire housing or cap member 220 is molded or treated with an antimicrobial component. In this embodiment, the boss portion 232 extends beyond the tubular nozzle portion 228 of the integral diaphragm structure 224. In addition, the conical nipple 230 projects through the terminal discharge opening 229 of the tubular portion 228. The extension of the nipple 230 normally plugs and closes the discharge port 229 until sufficient hydraulic pressure of the dispensed fluid within the enlarged clearance A opens the port 229 to passage of the liquid around the nipple extension 230 leading to discharge from the housing discharge aperture 234 as indicated by the arrow B designating the liquid discharge flow path. When the liquid dispensing flow has stopped, the port 229 again closes around the nipple extension 230 so that any residual liquid potentially exposed to air contamination is isolated and maintained microbially sterile within a housing clearance C between the nozzle portion 228 and the antimicrobial composition of the housing 220 and boss 232. The closure of the port 229 around the nipple extension 230 prevents any backflow of retained liquid within the large clearance space C into the clearance space A so that the normal engagement of the tubular portion 228 with the projection of the nipple portion 230 at the port 229 provides a secondary seal. This secondary seal isolates any fluid exposed to potentially leaching contact with the antimicrobial agent from upstream contact with the primary seal at the one-way dispensing valve portion 224*b*, or contact with the main supply of stored sterile liquid within container 212.

Referring to FIG. 9, a fourth embodiment of the nozzle assembly in accordance with the invention and designated generally by reference character 310 is similar to the nozzle assembly shown in FIG. 8 but in which the antimicrobial housing portion 320 includes an axial, inwardly projecting discharge tube portion 322 which provides a terminal discharge passageway 324 for the dispensed liquid. The discharge tube 324 is inserted and engaged against the tubular nozzle portion 328 of the integral diaphragm structure 324. The inwardly projecting tube 322 reduces the volume of retained liquid in the clearance space C within the antimicrobial housing 320 downstream from the nipple portion 330. Additionally, the tubular nozzle portion 328 has a radially inwardly projecting annular lug 329 which normally engages the nipple portion 330 to provide a secondary seal preventing any backflow of retained liquid from clearance space C into the clearance space A which is immediately downstream from the sealing ring 338 of the primary valve 324*b*.

Referring to FIG. 10, a fifth embodiment of the nozzle assembly in accordance with the invention and designated generally by reference character 510 is similar to the nozzle assembly shown in FIG. 9 but in which the antimicrobial housing portion 520 includes an axial, inwardly projecting tongue portion 522 which extends into and normally plugs and closes the discharge port 529 of the tubular portion 528. With sufficient hydraulic pressure of the dispensed fluid within the enlarged clearance space A, the port 529 opens to passage of the liquid around the tongue 522 leading to discharge from the housing the discharge aperture 534 which is arranged offset from the tongue 522, as indicated by the arrow B designating the liquid discharge flow path.

When the liquid dispensing flow has stopped, the port 529 again closes around the tongue 522 so that any residual liquid potentially exposed to air contamination is isolated and maintained microbially sterile within a housing clearance C between the housing portion 528 and the antimicrobial composition of the housing 520 and boss 532. The closure of the port 529 around the tongue 522 prevents any backflow of retained liquid within the large clearance space C into the clearance space A so that the normal engagement of the tubular portion 528 with the projecting tongue 522 at the port 529 provides a secondary seal. The secondary seal isolates any fluid exposed to the potentially leaching contact with the antimicrobial agent from further upstream contact with the primary seal at the one-way dispensing valve portion 524*b* of the diaphragm structure 524, while contact with the main supply of stored sterile liquid within the container 512.

Referring to FIG. 11, a sixth embodiment of the nozzle assembly in accordance with the invention and designated generally by reference character 610 is similar to the nozzle assembly shown in FIG. 8 but in which the nipple 630 has an end portion 633 which has the molded composition including the antimicrobial component so that the antimicrobial component can be omitted from the larger housing portion (not shown). The separately molded nipple end portion 633 is secured to the main body of the nipple 630 which can also be separately molded and then secured to the adapter 618. The antimicrobial nipple end portion 633 normally plugs and closes the discharge port 629 of the tubular nozzle portion 628 until sufficient hydraulic pressure of the dispensed fluid within the enlarged clearance space A opens the port 629 to passage of the liquid around the nipple end portion 633. When the liquid dispensing flow is stopped, the port 629 again closes around the nipple end portion 633 so that any residual liquid retained downstream in contact with the nipple portion 633 is thereby maintained microbially sterile and is also maintained isolated from the clearance space A upstream therefrom, and any liquid retained within clearance space A will not be in potentially leaching contact with the antimicrobial nipple tip 633.

Figure 12:
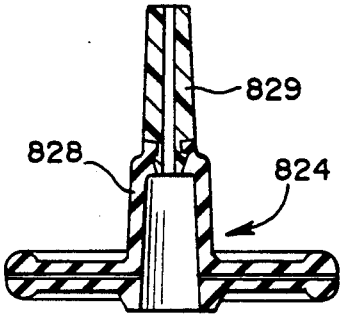
FIG. 12 is sectional view of a seventh embodiment of a liquid discharge nozzle assembly in accordance with the invention.

Referring to FIG. 12, a seventh embodiment of the nozzle assembly of the invention is similar to the nozzle assembly shown in FIG. 11 but in which the tubular diaphragm portion 728 has a normally closed liquid discharge slit 729 similar to that shown in FIG. 5, which provides a secondary seal. Any fluid retained within the clearance space C upstream of the slit 729 is maintained microbially sterile in contact with the antimicrobial composition of the projecting nipple 730.

Figure 13:
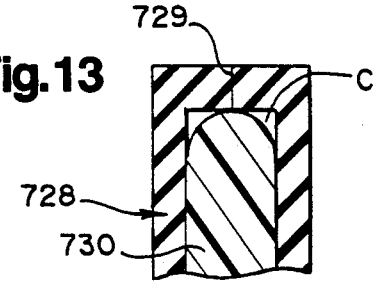
FIG. 13 is a sectional view of a modified integral diaphragm and liquid discharge element employed in an eighth embodiment of a nozzle assembly in accordance with the invention.

Referring to FIG. 13, an eighth embodiment of the nozzle assembly in accordance with the invention includes a tubular nozzle tip 829 which is molded from a composition including the antimicrobial component; the tubular tip 829 is secured to the end of the tubular nozzle portion 828 of the integral diaphragm structure 824 so that the nozzle tip 829 provides an antimicrobial dispensing discharge passage, and the antimicrobial component can be omitted from both the nipple and housing portions (not shown).

Figure 14:
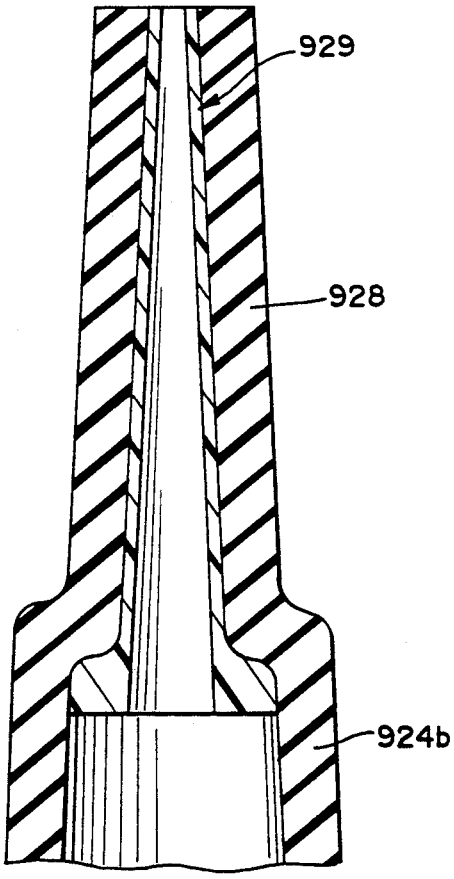
FIG. 14 is an enlarged sectional view of a modified discharge portion of an integral diaphragm and discharge element similar to that shown in FIG. 13.

Referring to FIG. 14, a ninth embodiment of the nozzle assembly in accordance with the invention is similar to the nozzle assembly shown in FIG. 13, but in which the antimicrobial tubular tip 929 is extended to form a sleeve insert passage through the entire tubular nozzle portion 928 and interiorly extends to the upper end of the columnar valve portion 924*b*.

Figure 15:
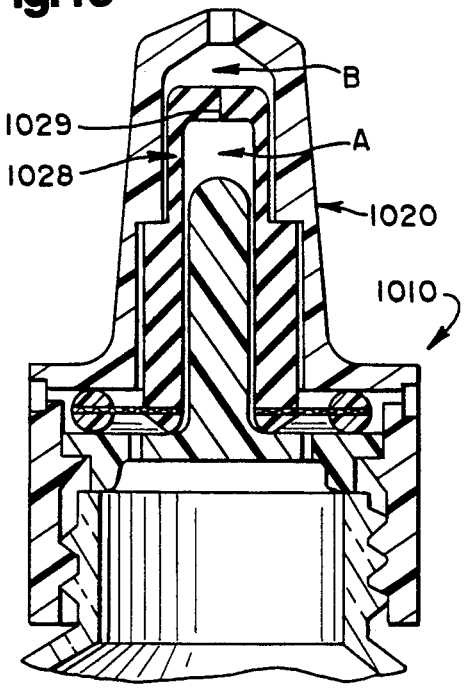
FIG. 15 is a sectional view similar to FIGS. 8-10, showing a tenth embodiment of a nozzle structure in accordance with the invention.

Referring to FIG. 15, a tenth embodiment of the nozzle assembly in accordance with the invention and designated generally by reference character 1010 is similar to the nozzle assembly shown in FIG. 8 but in which the end of the tubular nozzle portion 1028 has a normally closed liquid discharge slit 1029 which opens and closes in response to hydraulic pressure of the liquid dispensed. The housing portion 1020 has a composition including the antimicrobial component which is not in contact with retained liquid in the clearance space A but is only in contact with retained fluid in clearance space B. Any potential leaching of the antimicrobial component into the retained liquid in clearance B is isolated from the retained liquid in clearance space A by the secondary seal formed by the closed slit 1029.

While particular embodiments of the present invention have been described herein, it will be obvious to those skilled in the art that changes and modifications in various aspects may be made without departing from the broad scope of the invention. Consequently, the scope of the invention is not limited by any particular embodiment but is defined by the appended claims and the equivalents thereof.

The invention is claimed as follows:

1. A liquid dispensing nozzle assembly for mounting on a squeezable liquid container and dispenser to maintain liquid in sterile condition during storage and repeated dispensing from the container, said nozzle assembly comprising: conduit means having a liquid discharge port opening to the ambience for discharge of said liquid therethrough to dispense the liquid from the container, wherein said discharge port is formed through a discharge passage in said conduit means having a composition comprising an antimicrobial component, in order to maintain microbially sterile condition of any said liquid retained against said discharge passage, following said liquid dispensing from said discharge port.

2. A nozzle assembly according to claim 1, wherein said conduit means further comprises control means for controlling flow of said liquid from said container to said port, and wherein said discharge passage comprises a housing member within which said control means is secured.

3. A nozzle assembly according to claim 2, wherein said control means comprises valve means for controlling one-way flow of said liquid from said container to said discharge port.

4. A nozzle assembly according to claim 2, wherein said discharge passage of said conduit means projects from said control means secured within a housing portion of said nozzle assembly.

5. A nozzle assembly according to claim 1, further comprising an outer casing structure within which said discharge passage is secured.

6. A nozzle assembly according to claim 5, wherein said casing structure is integral with a valve means for controlling one-way flow of said liquid from said container to said discharge port.

7. A nozzle assembly according to claim 6, wherein said discharge passage comprises a tubular sleeve extending from said valve means through said casing structure.

8. A nozzle assembly according to claim 1, wherein said discharge passage includes a normally collapsed tubular configuration defining said discharge port in a closed condition, said collapsed tubular configuration being opened by hydraulic pressure of said liquid discharged therethrough.

9. A nozzle assembly according to claim 1, wherein said discharge passage includes a circular prism portion having an opening slit defining said discharge port.

10. A liquid dispensing nozzle assembly for mounting on a squeezable liquid container and dispenser to maintain liquid in sterile condition during storage and repeated dispensing from the container, said nozzle assembly comprising: conduit means having a liquid discharge port leading to the ambience for discharge of said liquid therethrough to dispense the liquid from the container, and an obstruction member secured adjacent to said discharge port and at least partially obstructing discharge of said liquid through said discharge port, said obstruction member having a composition comprising an antimicrobial component, in order to maintain microbially sterile condition of any said liquid retained against said obstruction member following said liquid dispensing from said discharge port.

11. A nozzle assembly according to claim 10, wherein said obstruction member is secured immediately upstream of said discharge port.

12. A nozzle assembly according to claim 10, wherein said obstruction member projects within said discharge port.

13. A nozzle assembly according to claim 10, wherein said obstruction member comprises a tubular portion inserted within said discharge port.

14. A nozzle assembly according to claim 13, wherein said tubular portion extends from a housing portion of said nozzle assembly.

15. A liquid dispensing nozzle assembly for mounting on a squeezable liquid container and dispenser to maintain liquid in sterile condition during storage and repeated dispensing from the container, said nozzle assembly comprising: conduit means having a liquid discharge structure leading to the ambience for discharge of said liquid therethrough to dispense the liquid from the container, wherein said discharge structure includes a composition comprising an antimicrobial component, in order to maintain microbially sterile condition of any said liquid retained in said discharge structure, following said liquid dispensing therefrom.

16. A liquid dispensing nozzle assembly for mounting on a squeezable liquid container and dispenser to maintain liquid in sterile condition during storage and repeated dispensing from the container, said nozzle assembly comprising: conduit means having a liquid discharge port leading to the ambience for discharge of said liquid therethrough to dispense the liquid from the container, and liquid discharge structure including said liquid discharge port, wherein said discharge structure includes a composition comprising an antimicrobial component, in order to maintain microbially sterile condition of any said liquid retained against said discharge port following said liquid dispensing therefrom.

* * * * *